US005558604A

United States Patent [19]

Hopkins

[11] Patent Number: 5,558,604

[45] Date of Patent: Sep. 24, 1996

[54] AQUATIC TREADMILL APPARATUS

[76] Inventor: Thomas H. Hopkins, 201 Gore Creek Dr., Vail, Colo. 81657

[21] Appl. No.: 252,702

[22] Filed: Jun. 2, 1994

[51] Int. Cl.[6] ..... A63B 22/02

[52] U.S. Cl. ..... 482/54; 482/111

[58] Field of Search ..... 482/51, 54, 111

[56] References Cited

U.S. PATENT DOCUMENTS

| | | | |
|---|---|---|---|
| 4,332,217 | 6/1982 | Davis . | |
| 4,576,376 | 3/1986 | Miller . | |
| 4,602,779 | 7/1986 | Ogden | 482/54 |
| 4,712,788 | 12/1987 | Gaudreau, Jr. . | |
| 4,776,581 | 10/1988 | Shepherdson . | |
| 4,918,766 | 4/1990 | Leonaggeo, Jr. | 482/54 |
| 4,938,469 | 7/1990 | Crandell . | |
| 5,108,088 | 4/1992 | Keller et al. . | |
| 5,123,641 | 6/1992 | Abboudi et al. | 482/54 |
| 5,163,885 | 11/1992 | Wanzer et al. | 482/54 |
| 5,302,162 | 4/1994 | Pasero | 482/54 |
| 5,368,532 | 11/1994 | Farnet | 482/54 |

*Primary Examiner*—Lynne A. Reichard
*Attorney, Agent, or Firm*—John E. Reilly

[57] ABSTRACT

An underwater treadmill apparatus is made up of a treadmill belt trained over a drive roller and take-up roller, a fluid drive motor and flywheel coupled to a common drive shaft in direct driving relation to the drive roller, and an isolated power source outside of the body of water includes an electric motor-driven hydraulic pump to direct hydraulic fluid under pressure to the hydraulic drive motor. The upper course of the treadmill belt advances over a rigid deck having an upper cushion layer with raised straddle portions on each side, and the take-up roller is resiliently mounted at one end of the deck. A bonding grid break and sacrificial anodes are provided to inhibit corrosion, and the treadmill frame can be placed in compressible padding and be leveled from a point above the surface of the water, for example, when placed in a swimming pool.

43 Claims, 7 Drawing Sheets

AQUATIC TREADMILL APPARATUS

BACKGROUND AND FIELD OF INVENTION

This invention relates to exercise and therapy apparatus; and more particularly relates to a novel and improved underwater treadmill which enables the exerciser to utilize the effects of buoyancy and resistance of water in walking, jogging and running.

Treadmills have become increasingly popular as a form of exercise and therapy. With the treadmill, an individual is able to adjust speed and resistance to suit one's exercise requirements while avoiding inclement weather conditions and poor outdoor running surfaces. Dry treadmills are in widespread use but tend to jar the body and be extremely hard on the joints when used for any length of time to the extent that they can cause injury. Accordingly, submerged or underwater treadmills have been devised in an effort to overcome drawbacks of the dry treadmills and provide additional benefits not offered by dry treadmills. Representative treadmills of the aquatic or submerged type are those disclosed in U.S. Pat. Nos. 4,332,217 to Davis, 4,576,376 to Miller, 4,712,788 to Gaudreau, Jr., 4,776,581 to Shepherdson, 4,938,469 to Crandell, 5,108,088 to Keller et al, and 5,123,641 to Abboudi et al.

Among other problems associated with the use of a submerged treadmill is the ability to deliver the necessary power to the treadmill so that it is capable of operating over a wide range in speed and overcome the resistance effects of the water while completely isolating the electrical power source from the water. Additional resistance is imposed each time that the foot is planted on the treadmill surface which, with the motive power source isolated from the treadmill, tends to cause a jerky motion in the treadmill. Further, by virtue of the buoyant effects of the water, there is a tendency for each foot-plant to cause water to squirt from beneath the treadmill and to lift the tail end of the treadmill causing an extremely unstable condition. At the same time, it is important that the take-up roller be capable of compensating for the additional resistance imposed by each foot-plant on the treadmill belt and that the drive roller achieve the necessary traction with the treadmill belt and overcome the effects of water passing between the drive roller and belt.

In swimming pools, exercise pools and the like, all metal objects must be connected to a pool bonding grid which can tend to induce corrosion in the metal parts of a treadmill but in the past no satisfactory means has been devised for overcoming this problem. Among other problems and considerations are the ability to properly level the treadmill under Water, the difficulty of determining whether the treadmill is running when an individual first steps on it; also, to identify the presence of the treadmill when hidden below water, for example, when the treadmill is submerged in a swimming pool; and, for a similar reason, provide adequate padding on the treadmill to avoid injury if someone should accidentally dive or otherwise move into contact with the treadmill.

SUMMARY OF INVENTION

It is therefore an object of the present invention to provide for a novel and improved underwater treadmill which is durable and smooth-running in use and does not require positive attachment or anchoring of the treadmill or its drive system to a fixed support.

Another object of the present invention is to provide a drive system for a submerged treadmill having an isolated electrical power source and wherein the drive system is capable of compensating for water and foot-plant resistance when in use; and further wherein adequate protection is provided for the system against corrosion.

A further object of the present invention is to provide an underwater treadmill which is free-standing but stable and does not tend to vibrate or bounce when used in water while providing a comfortable running surface; and further wherein the treadmill is readily movable without disturbing its connection to an electric motor-driven power source.

A still further object of the present invention is to provide an underwater treadmill which can be conveniently leveled and inclined from above the water; and further is capable of being operated and controlled from a point outside of the pool or directly controlled by the exerciser to regulate speed of the treadmill belt.

An additional object of the present invention is to provide for an underwater treadmill which is conformable for use in different settings including in-ground and above-ground pools designed to accommodate the treadmill as well as large swimming pools occupied by swimmers, is transportable from site to site or for storage, and wherein the treadmill can be marked as well as padded to minimize the possibility of accidents.

In accordance with the present invention, there is provided in an underwater treadmill apparatus a treadmill belt having a drive roller and take-up roller about which the treadmill belt is trained and which is submerged in a body of water, drive means drivingly connected to the drive roller including a fluid operated drive motor and fluid pressure and return lines extending to and from the drive motor, and electric motor drive means located outside of the body of water including a fluid pump to deliver fluid under pressure via said pressure line to the drive motor. Preferably, the drive motor is a hydraulically operated motor which along with a flywheel is coupled to a drive shaft which in turn is mounted in direct association with and drivingly connected to the drive roller.

Individual components and subassemblies of the treadmill apparatus contain features which greatly enhance performance of the apparatus including but not limited to a novel and improved flywheel construction, drive roller, tread construction, rigid deck with upper cushion layer, and a take-up roller for the treadmill belt which is resiliently mounted at the rear end of the apparatus and which cooperates with the drive roller and treadmill deck to attain maximum comfort and smoothness in operation.

A motive power source is located outside of the body of water for activating the drive system through the use of an electric motor drive and hydraulic pump to deliver hydraulic fluid under pressure through a flexible line to the drive motor. In this way, the power source can remain stationary and the drive system and treadmill proper can be shifted or moved and does not require anchoring to a fixed support. A bonding grid break is operative to interrupt current flow through a bonding grid at low voltages and includes a surge suppressor for closing the bonding grid circuit at higher voltages. Corrosion is inhibited through the use of sacrificial anodes arranged in surrounding relation to the fluid motor drive.

In order to minimize the possibility of injury, the apparatus is preferably mounted in padding so as to prevent accidental contact with metal parts of the apparatus by swimmers when the apparatus is submerged in a swimming pool, and flags are provided to serve as warning devices for swimmers of the presence of the submerged apparatus. In addition, the treadmill belt is provided with a special marker to indicate to the exerciser whether the belt is running or not prior to stepping onto the treadmill.

The above and other objects of the present invention will become more readily appreciated and understood from a consideration of the following detailed description of preferred and modified forms of the present invention when taken together with the accompanying drawings in which:

DETAILED DESCRIPTION OF PREFERRED EMBODIMENT

Figure 1:
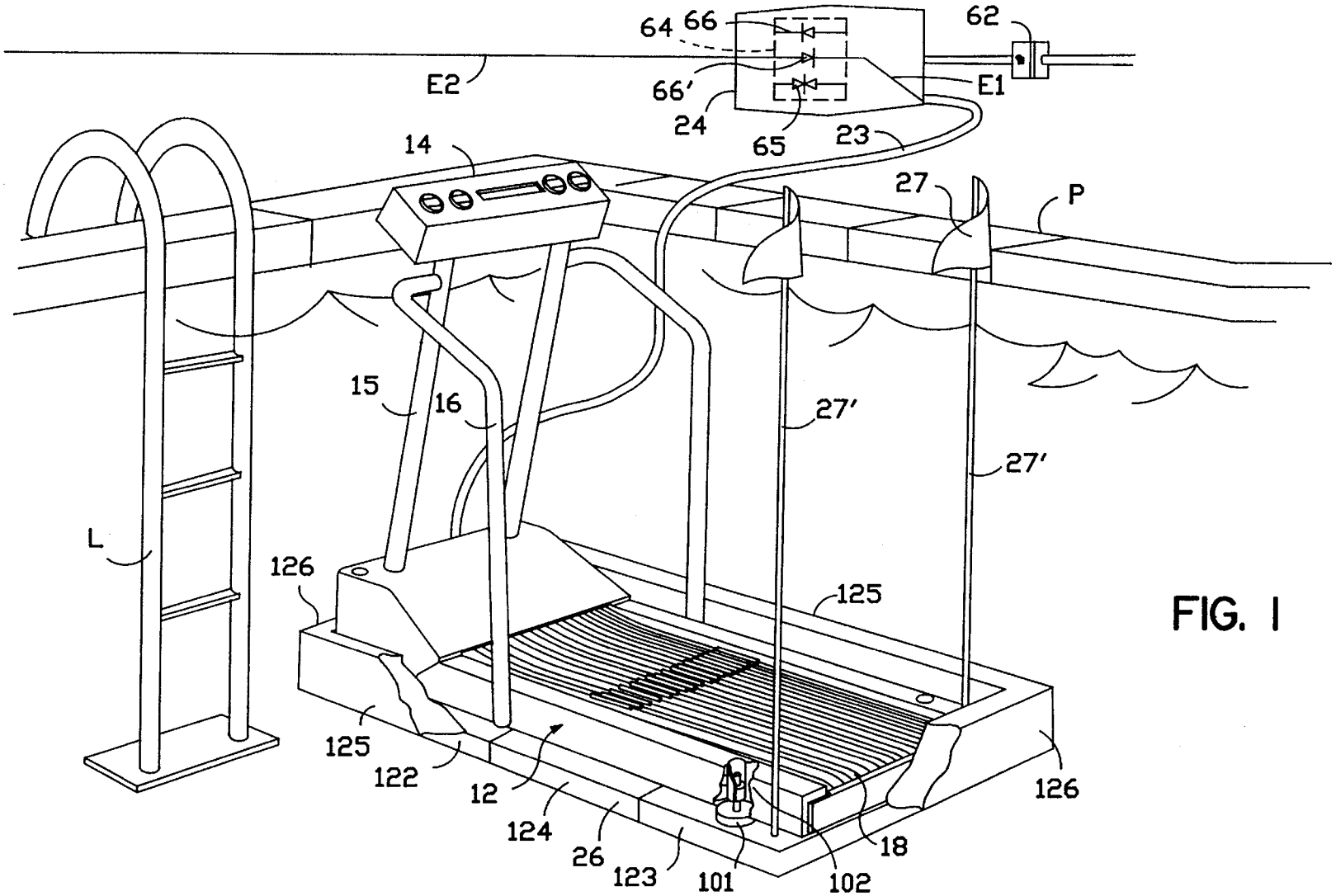
FIG. 1 is a perspective view of a preferred form of treadmill apparatus positioned in a swimming pool.

Referring in more detail to the drawings, there is shown in FIGS. 1 to 7 a submerged treadmill apparatus 10 broadly comprised of a rigid rectangular frame 12, a control console 14 supported by posts 15 in vertically spaced relation to the frame 12 hand rails 16, a treadmill belt 18 trained over a drive roller 19 and a driven or take-up roller 20, and a drive system 22 having a cable 23 for hydraulic lines to be hereinafter described which extend to and from a motive power source 24. As a setting for the present invention, the apparatus 10 is shown submerged in a swimming pool P and, for this purpose, the apparatus 10 has padding 26 in outer surrounding relation to the frame 12 and upstanding flags 27 on holders or standards 27' which extend above the water surface in the pool P and, along with the control console 14, define the outer boundaries of the apparatus 10 so as to minimize the danger of swimmers accidentally striking or moving into contact with the treadmill apparatus. Similarly, the padding 26 is provided to minimize any danger of injury to occupants in the pool who may come into contact with the treadmill apparatus.

Figure 2:
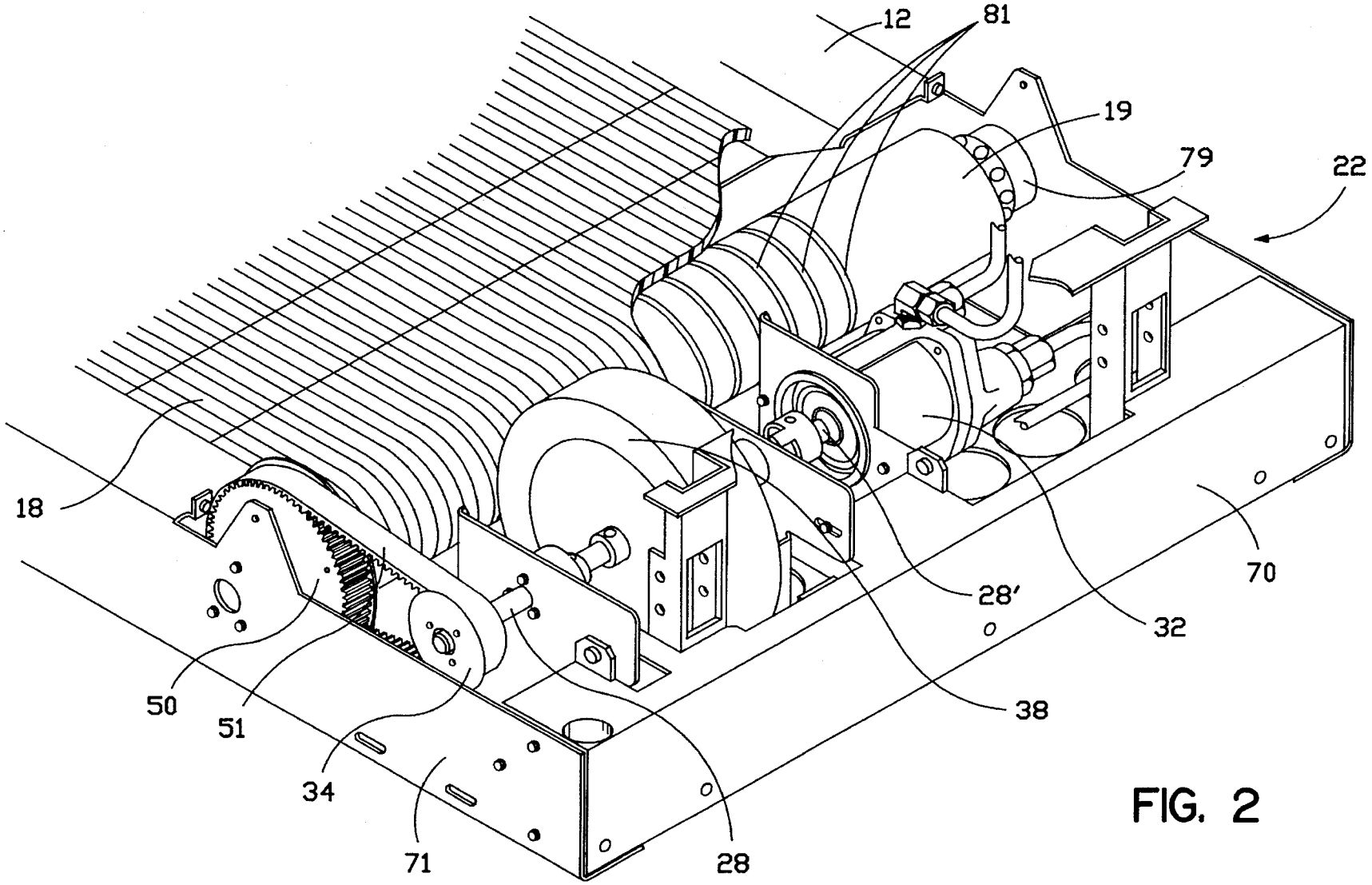
FIG. 2 is a somewhat fragmentary perspective view of the preferred form of submerged drive system and front end of the treadmill apparatus in accordance with the present invention.
Figure 3:
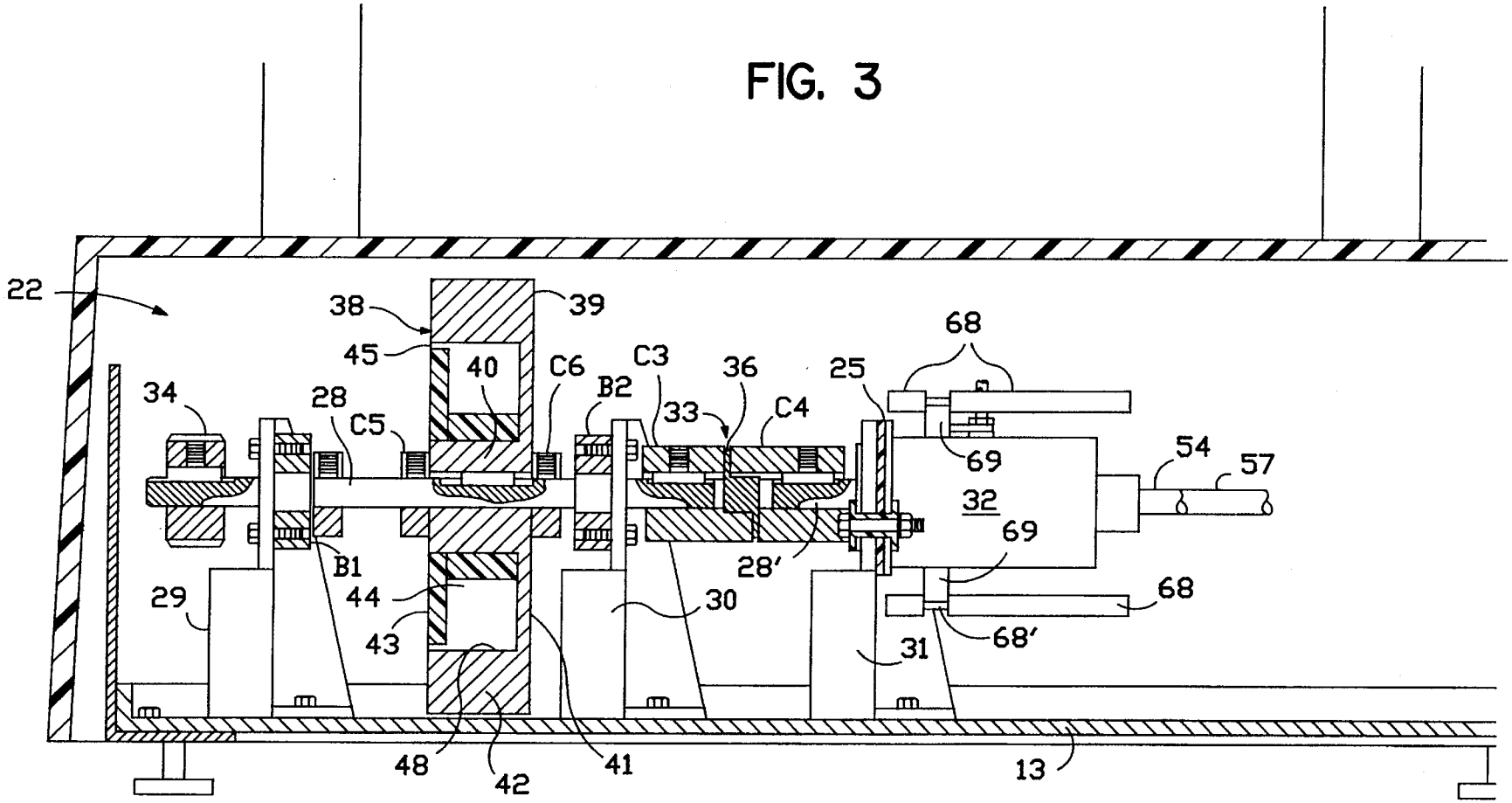
FIG. 3 is a cross-sectional view of a preferred form of submerged drive system for the apparatus of the present invention.

Referring to FIGS. 2 and 3, the treadmill belt 18 is driven by the drive system 22, the system 22 including a drive shaft 28 in journaled relation to upper ends of upstanding brackets 29, 30 and 31 which are anchored to a bottom panel 13 at the front end of the frame 12. A hydraulic motor 32 is mounted on the bracket 31 but is electrically separated from the bracket 31 by a non-conductive gasket 25 and sleeve 25' which surround the mounting bolts as illustrated, and the motor 32 includes a shaft portion 28' at its output for driving the shaft 28 via coupling 33 into a sprocket 34 at the opposite end of the shaft 28. The drive shaft 28 is supported in journaled relation with respect to the brackets 29 and 30 by bearings B1 and B2, respectively, and the coupling 33 is comprised of collars C3 and C4 keyed to the shaft portions 28 and 28', separated by a common non-conductive spider or washer 36 which will impart rotation of the shaft portion 28' into the shaft 28 while compensating for any misalignment between the shaft portions.

Dry treadmills typically employ a DC motor to maintain a smooth running condition so that each time someone steps on the treadmill belt, referred to as a "foot-plant" a sensor instantly picks up the slight increase in resistance and a controller directs a signal to the motor to cause it to respond with pulses of extra power. This happens in milliseconds and causes the treadmill belt to move smoothly in a forward direction. In addition, a flywheel is usually mounted next to the electrical motor to assist in maintaining the smooth running condition and overcoming the resistance of foot-plants. In the submerged system in accordance with the present invention, the resistance or pause resulting from a foot-plant can be quickly detected but the electrical motor in the power source 24 is sufficiently removed that it requires about one second for the extra energy in the hydraulic line to arrive at the hydraulic motor 32 and therefore tend to cause jerking movement of the belt 18. In order to overcome this condition, a flywheel 38 is keyed directly to the drive shaft 28 between the motor 32 and sprocket 34 to supplement the rotational force of the motor and is firmly anchored between two collars C5, C6. Thus, the kinetic energy stored by the flywheel must be sufficient to overcome the resistance of each foot-plant in maintaining a smooth running condition. To this end, the flywheel 38 is so constructed and arranged as to provide maximum mass or weight toward the outer peripheral surface of the flywheel and, in the preferred form, the flywheel 38 includes a generally C-shaped disk 39 including a hub portion 40 keyed to the shaft 28, sidewall 41 and outer thick-walled peripheral portion 42. The flywheel 38 is designed such that the total effective weight or mass together with the diameter will generate sufficient centrifugal force to overcome the momentary resistance introduced by each foot-plant and, for the purpose of illustration, for a hydraulic motor 32 having a rotational force or thrust on the order of 14 foot lbs., the flywheel will have a diameter on the order of 9" and weigh on the order of 20 lbs. to generate a total of 775 foot lbs. centrifugal force when the treadmill speed is 8 mph. A flat plate 43 is affixed to one side of the peripheral portion 42 opposite to the sidewall 41 so as to define a hollow disk with an interior chamber or space 44. Apertures 45 extend through the plate 43 to admit water into the chamber 44 and increase the total weight or mass of the flywheel 38 without increasing the drag especially along interface 48 between the chamber 44 and outer portion 42 when the treadmill is submerged in water and during high speed operation will tend to resist the rotational force of the motor. The sprocket 34 is connected to a sprocket 50 on the drive roller 19 by a cog drive belt 51 to impart rotation of the drive shaft 28 into the drive roller 19.

Figure 7:
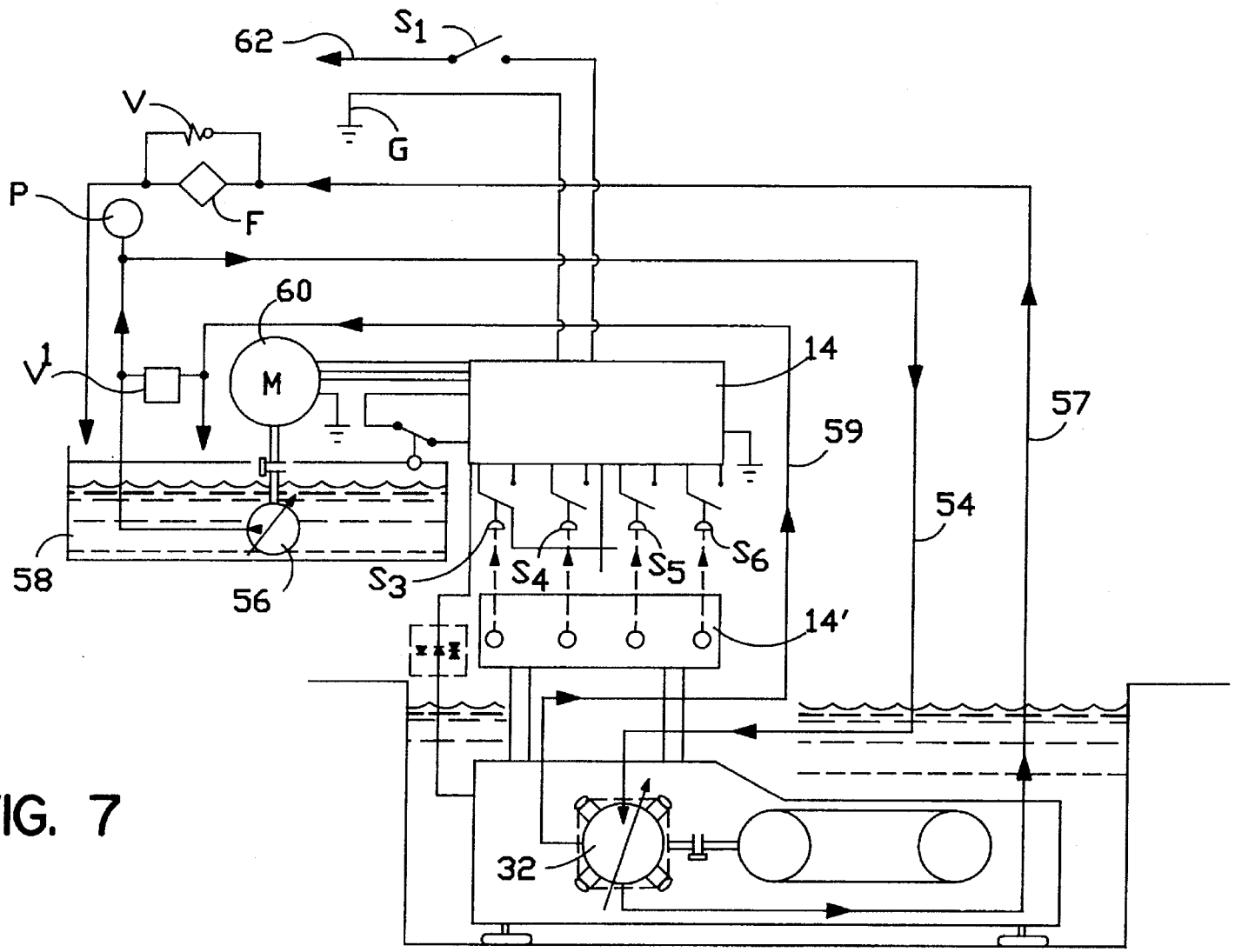
FIG. 7 is a hydraulic circuit diagram with portions of the electrical system shown schematically.

An important feature of the present invention resides in controlling the drive system 22 and particularly the motor 32 from a remote power source 24 removed from the body of water in which the apparatus 10 is submerged. As shown in FIG. 7, a hydraulic pressure line 54 extends from a pump 56 at the isolated power source into the motor 32, and a hydraulic return line 57 extends from the motor 32 into a reservoir 58, the latter containing a hydraulic fluid which is preferably a fluid sold under the trademark "AQUACISER NO. 32™" by Aquaciser, Inc. of Vail, Colo. A case drain line 59 extends from the motor 32 into the reservoir 58. The majority of the fluid returns to the reservoir 58 from the hydraulic motor 32 via the return line 56 and passes through a filter F including a check valve V to allow fluid to bypass the filter if pressure builds up due to clogging in the filter F. A minor amount of the fluid returns to the reservoir 58 via the case drain line 59 in order to protect the seals in the motor 32 and minimize the possibilty of leakage. The lines 54, 57 and 59 as well as conductor E1 to be described are encased in the cable 23 leading from the power source 24 to the motor 32. The pressure line 54 also includes a pressure gauge P and a pressure release valve V' to return fluid directly to the reservoir 58 via the case drain line 59 in the event of failure of the motor 32. The hydraulic pump 56 is driven by an electric motor 60, the electric motor 60 being energized and controlled by a control assembly 14' in the console 14 and the control assembly is connected to an electric power source represented at 62 and having an on-off switch S1. The control console 14 and control assembly 14' form no part of the present invention as such and operate in a well-known manner to regulate the rate of speed of the motor 60. In order to conform to code requirements, the electric power supply 62 is hard-wired and, for example, either may be a three-phase/20 amp/208–240 volt supply or single-phase/30 amp/220 volt supply. Typically, the console 14 may include a series of four pushbuttons B which are manually controlled to regulate switches S3, S4, S5 and S6 which, respectively, turn on the motor 60, increase motor speed, decrease motor speed and turn off the motor 60. A meter, not shown, records the time that the motor 60 is on. Further, in accordance with well-known practice, a sensor on the drive roller 19 senses rpm of the drive roller 19 and displays on the console 14 in miles per hour and distance. Elapsed time may also be displayed and all three are reset to zero when switch S6 is opened to turn the motor off.

It is necessary to conform to code requirements by bonding the apparatus 10 to the pool's bonding grid, as shown in FIG. 1, and which consists of an electrical conductor E1 which extends through cable 23 between the submerged part of the apparatus 10 and the power source 24 and another conductor E2 being connected between the power source 24 and a metal portion on the pool, such as, the pool ladder L as well as to ground the system at the power supply as further represented at G in FIG. 7. In accordance with the present invention, in order to prevent corrosion to the treadmill frame 12 or to metal parts in the pool caused by the bonding circuit, a low voltage bonding grid break 64 comprises two avalanche diodes 66 and 66' of opposing polarity with a surge suppressor 65, all in parallel. The bonding grid break 64 is non-conductive at low voltages less than 2 volts but will close and become a two-way conductor at a low threshold voltage above 2 volts and is capable of carrying a very high current for a short period without fusing or damage, such as, 5,000 amps for five cycles. Again, in accordance with code requirements, all metal objects in and around a swimming pool must be connected to the pool bonding grid to insure that there is no potential difference between metal objects, such as, between the treadmill apparatus 10 and the pool ladder L. This is to prevent a deadly discharge should lightning, for example, strike near the pool. However, by electrically connecting the treadmill apparatus with all metal objects in and around the pool, corrosion can be induced in the apparatus or in any metal parts, depending upon the composition of metal and its relative standing on the galvanic series in pool water which, for example, may be chlorinated, brominated, salted, ozonated or peroxided, and acts as an electrolyte causing a galvanic cell to be set up. Specifically, the diodes 66 and 66' effectively operate at lower voltages to open at less than 2 volts. At the 2 volt to 40 volt range, one of the diodes 66 and 66' operates to dissipate potential differences depending upon direction of the potential difference, and the surge suppressor operates at greater than 40 volts to close in order to dissipate substantial potential differences.

As further shown in FIG. 3, sacrificial anodes 68 are arranged in radially outer spaced relation to the motor 32 and at four equally spaced circumferential intervals by insulators 69. Preferably, the anodes 68 are composed of magnesium, aluminium, zinc or other metal so that their relative position on the galvanic scale in relation to the composition of the motor will cause the motor to act as a cathode and is protected while the anodes 68 will corrode. Thus, corrosion of the motor 32 is prevented by coating with an insulating material, electrically separating it from the metal frame 12 and connecting it to the sacrificial anodes 68. The bonding grid break 64 as described offers additional corrosion resistance for the treadmill frame 12 as well as other parts of the pool for the reasons previously discussed. In forming the anodes 68, they may be cut to length from a solid ribbon anode, and each length is preferably supported by one or more wires 68' extending axially therethrough. Further, each length is split or divided to afford a spacing or gap for mounting of the wire 68' on the insulators 69.

As best seen from FIGS. 2 to 5, the treadmill frame 12 includes a front housing 70 for the drive system 22, the bottom panel 13 being rigidly affixed to sidewalls 71 and front end wall 70, and a rear end wall 73 takes the form of a guard for the take-up roller 20. Upper horizontal ledges 74 define raised straddle areas extending inwardly toward one another from the sidewalls 71, and a central deck 75 is sunken or depressed between the straddle areas 74 for extension of the treadmill belt 18 beneath the area 74 and above the deck 75. It is especially important to raise the straddle areas 74 above the level of the treadmill belt 18 in a submerged system so that the exerciser can more readily see where to stand in the water as well as to keep the treadmill belt 18 captured and minimize potential pinch points around the sides of the belt.

Figure 4:
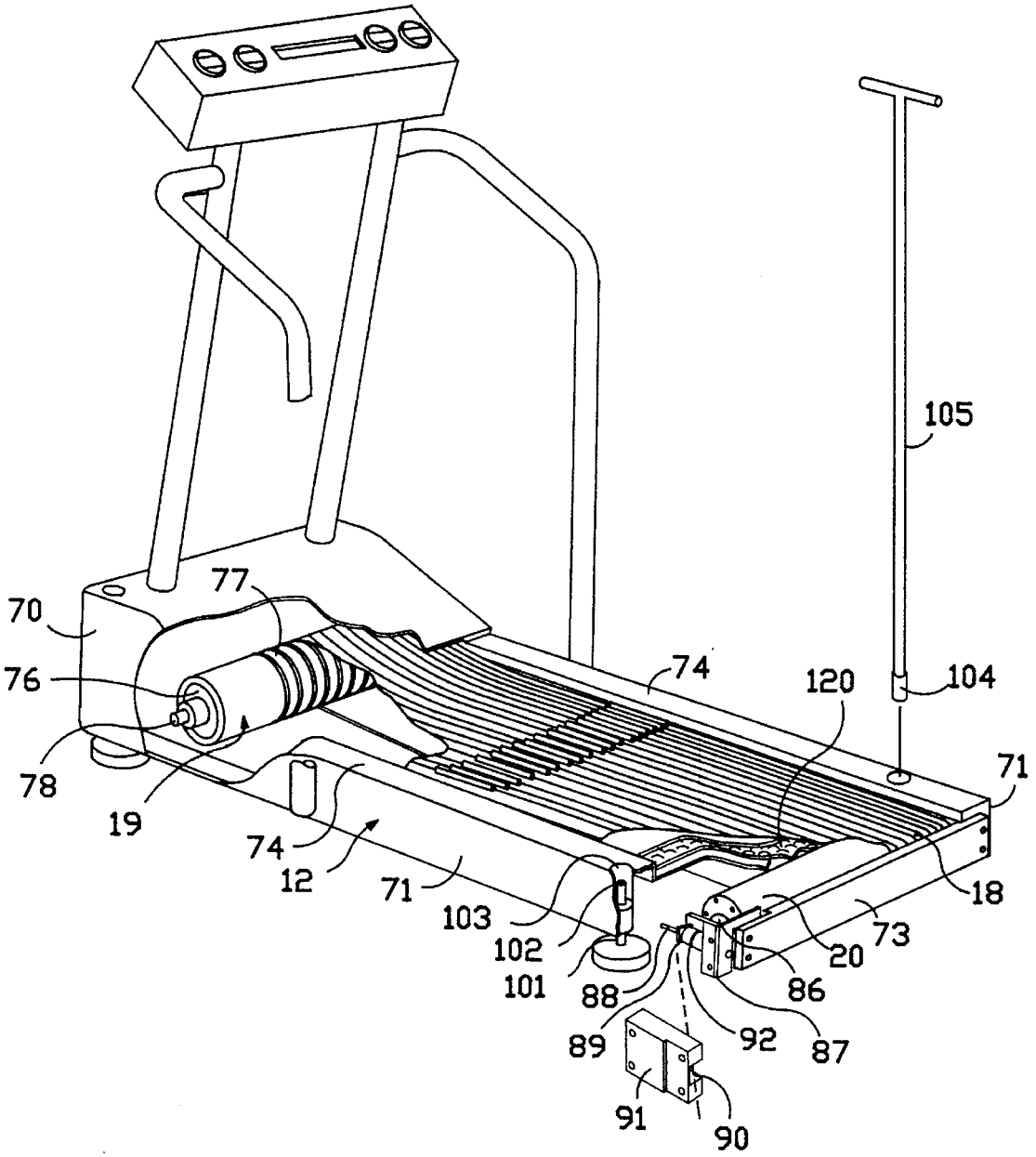
FIG. 4 is another perspective view of the treadmill apparatus with portions of the treadmill belt and deck broken away.

From FIGS. 2 to 4, the drive roller 19 includes a roller body 76 of elongated hollow cylindrical configuration covered by an outer tread 77 of vulcanized rubber or rubber-like material, and stub shafts 78 at opposite ends of the body 76 serve not only to seal off the hollow interior of the body but to mount the drive roller in bearings 79 on opposite sidewalls 71 of the frame 12. Preferably the outer tread section 77 is formed with circumferential grooves 81 at closely spaced intervals along the length of the tread 77 and is crowned slightly at the center of the roller to assist in maintaining proper tracking of the belt. The grooves in the tread portion 77 play an important function in an underwater system to allow the water between the treadmill belt 18 and roller 19 to be expelled quickly and thereby achieve a firmer grip between the belt 18 and roller 19 resulting in less power needed to run the treadmill and less bearing wear.

Figure 5:
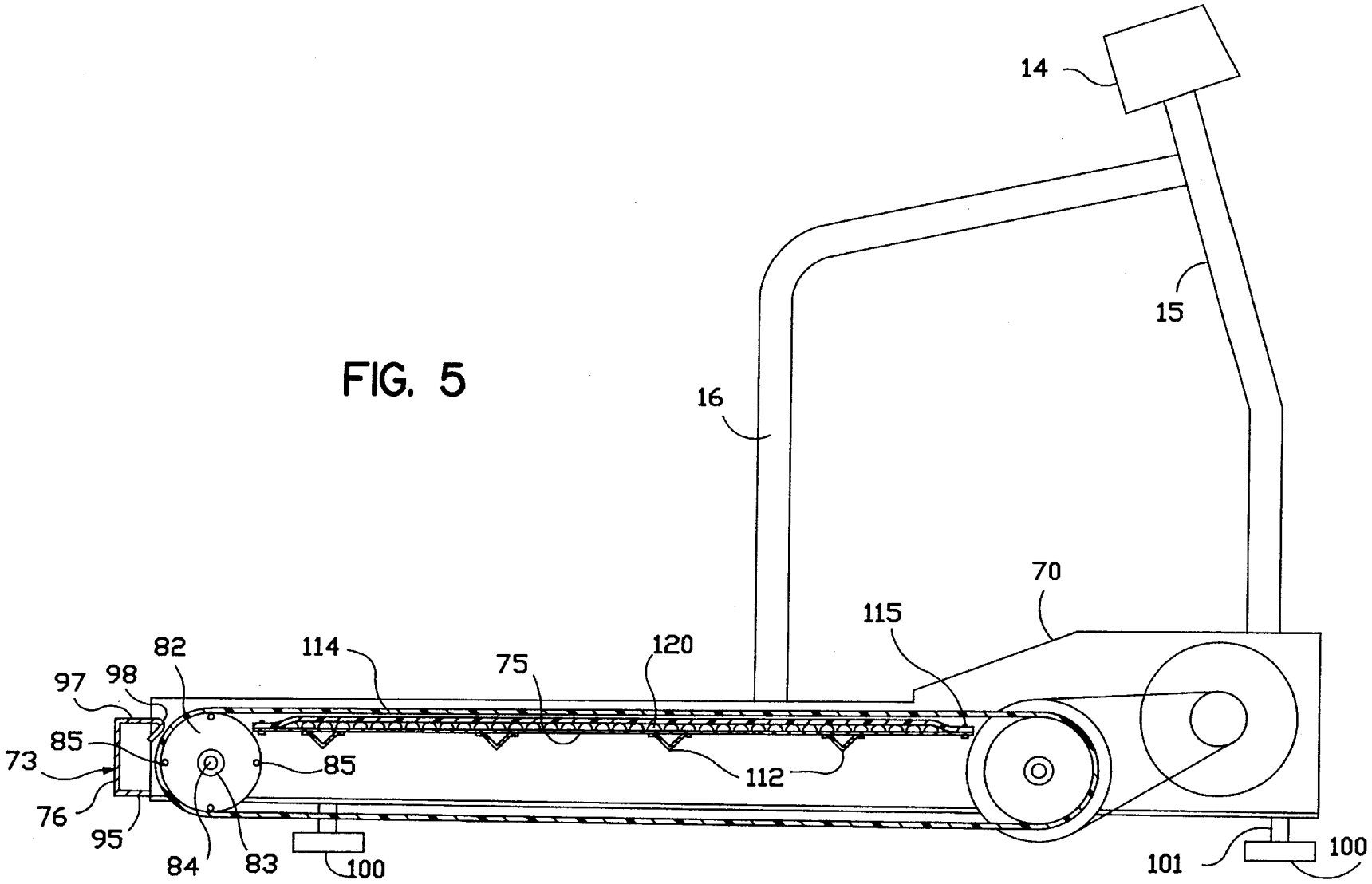
FIG. 5 is a longitudinal sectional view through the treadmill belt assembly of the preferred form.

Referring to FIGS. 4 and 5, the take-up roller 20 is mounted at the rear end of the frame 12 and comprises a roller body 82 of elongated hollow, generally cylindrical configuration with a cross-sectional diameter corresponding to that of the drive roller 19. Each of the opposite ends of the body 82 is closed by a collar 83 mounted on a stub shaft 84 and apertures 85 at spaced circumferential intervals around each end of the roller body 82 permit entry of water into the hollow interior of the body. Each of the shafts 84 is supported in a bearing 86 adjustably mounted with respect to a bearing plate 87 at the rear extremity of each sidewall 71 by a bolt 88 which bears against the plate 87 and threads into a square nut 89 which is mounted in a slot 90 of a bearing block 91, the block 91 being mounted in a sidewall 71 with the slot 90 aligned with the bolt 88. An elongated resilient sleeve or washer 92 is placed on each bolt 88 to yieldably tension each end of the take-up roller 20 with respect to the treadmill belt 18. The take-up roller 20 serves to maintain the necessary tension on the treadmill belt 18 to cause it to grip the drive roller 19. Thus, the bearing assembly affords manual adjustment of the take-up roller 20 by manually tightening or loosening the bolts 88 on each side. However, the bearing plate 87 is free to undergo limited movement toward and away from the bearing block 91 against the urging of the washer 92, and this movement will occur primarily in response to each foot-plant to permit the take-up roller 20 to momentarily move forwardly and compress the washer 92.

The take-up roller guard 73 traverses the rear end of the frame 12 behind the take-up roller 20, the guard 73 being of generally U-shaped cross-sectional configuration having a lower end 95, a vertical end wall 96 which is attached at opposite ends of the bearing plate 87, and an upper end 97 which extends forwardly toward the take-up roller and terminates along its longitudinal edge in a downwardly and rearwardly inclined return 98. The roller guard 73 is so mounted that the upper return 98 is in close proximity to the take-up roller 20 and, being attached to the bearing plate 87, will move with the roller 20. The upper return portion 98 is slightly below the level of the belt 18 to minimize the possibility that the exerciser could stub his heel on the guard while at the same time avoiding the possibility of pinching or jamming of one's fingers or toes.

The apparatus is vertically adjustable primarily for leveling purposes through the use of adjustable feet 100 beneath each corner of the frame 12, each foot being in the form of a solid disk having an upwardly extending, threaded stem 101 terminating in a square or polygonal end 102, as best seen from FIG. 4. Each foot extends upwardly through a socket 103 in the frame, the socket 103 being sized to permit insertion of a socket end wrench 104 at the lower end of an elongated crank arm 105. In this way, the apparatus and specifically the frame 12 can be leveled from a point above the water by threadedly adjusting each foot 100 with the aid of the crank 105 thereby avoiding the necessity of diving into the pool and attempting to manually adjust each foot. This is of particular importance when the apparatus 10 is to be used in swimming pools which typically have sloped bottoms and therefore require substantial adjustment to level the apparatus in the water.

Figure 6:
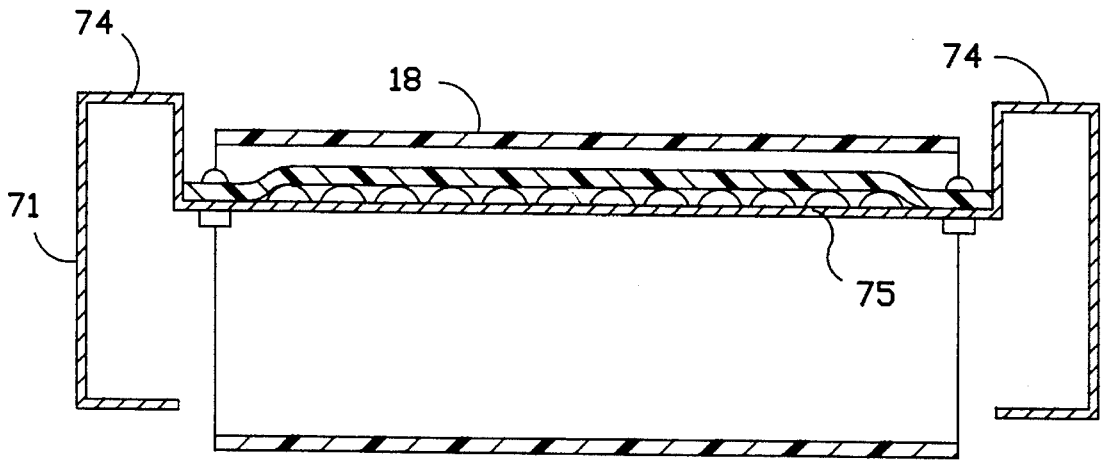
FIG. 6 is a cross-sectional view through the treadmill belt assembly of the preferred form.

Referring to FIGS. 4 to 6, the treadmill belt 18 is of conventional construction and is in the form of an endless belt which is composed of a reinforced rubber or rubber-like material and, as shown in FIG. 6, has an upper course 108 and a lower course 110. A colored marker 112 extends transversely across one portion of the belt so that the exerciser can easily determine whether the belt is running before placing any weight on the belt. This is especially important in a submerged treadmill apparatus in which the movement of the belt is not as readily discernible from above the surface of the water. The deck plate 75 is given additional reinforcement by brace members 112 extending transversely beneath the deck and between opposite sidewalls 71.

In order to absorb the impact of each foot-plant on the belt 18, a cushion layer 120 may be interposed between the deck 75 and an upper cover plate 114 which is fastened as at 115 to the deck. The cushion layer itself is preferably composed of a material consisting of tightly packed, nested layers of bubbles having a webbing material around its outer edges to bind the layers together. For example, one suitable material is a 15 mil thickness Polyair commercial solar material with 0.375" by 0.188" bubbles. Preferably, the cushion layer as described occupies substantially the entire area of the deck. The effect is to form a compressible layer beneath the belt 18 so that the flexing movement of the belt is accommodated by compressing the air bubbles rather than by displacing water and is particularly effective when the deck 75 is rigid. In addition, the space between the belt 18 and cushion layer is occupied by water which will operate as additional cushioning between the belt 18 and cover plate 114. In the alternative, if the deck 75 is designed to be more flexible, one or more layers of compressible air corresponding to the cushion layer 120 may be attached to the underside of the deck 75 so that the deck's flexing movement is accommodated by compressing the air bubbles to a greater extent than mere displacement of water. In either event, the spacing between the upper course of the belt 18 and deck permits the water to absorb a great deal of the shock resulting from each foot-plant or impact each time that the exerciser's foot lands on the belt running surface.

Referring once again to FIG. 1, the outer protective padding 26 is preferably a compressible material including spaced bottom panels 122 and 123 beneath the front and rear ends of the frame 12 so as to leave a gap or spacing 124 therebetween, and opposite sidewalls 125 and end walls 126 surround opposite sides 71 and ends 70 and 73 of the frame. The feet 100 are illustrated as resting on the bottom panels 122 and 123 although, if desired, may extend through openings in the bottom panels to rest directly on the bottom surface of the pool. The outer padding structure as described not only affords some degree of protection to a person moving into contact with the treadmill from the sides or ends but will discourage any shifting of the treadmill along the pool surface and protect the pool bottom itself.

As alluded to earlier, the treadmill apparatus 10 is preferably of portable construction so as to be readily movable without disturbing its connection to the power source 24. Thus, the apparatus 10 can be easily installed in a pool or other body of water and, when not in use, can be removed and placed outside of the pool without disconnecting or moving the power source 24. Another distinct advantage is that the cable 23 can be of a sufficient length that the power source 24 may be located at considerable distances away from the submerged treadmill without affecting its operation and permit relocation of the treadmill proper.

From the foregoing, a novel and improved submersible treadmill apparatus has been devised which is relatively lightweight and portable while achieving operation over wide ranges of speed. For the purpose of illustration but not limitation, the electrical motor 60 may be a 3 HP high efficiency motor designated EM366ST rated to run at 1725 rpm sold by Baldor, Inc. of Fort Smith, Ariz., and the pump 56 is a fixed gear pump having a displacement of 0.394 in.$^3$/rev. sold by Parker Hannifin Corporation of Cleveland, Ohio. The motor 32 in the drive system may be a hydraulic piston motor having a 0.64 in.$^3$/rev. displacement sold by Vickers, Inc. of Troy, Mich. In the bonding grid break, avalanche diodes may comprise a MicroSemi S 3640 diode 66 of standard polarity and a MicroSemi R 3640 diode 66' of reverse polarity sold by MicroSemi Corporation of Santa Ana, Calif. The surge suppressor 65 is a Model MOV 67W 30100 manufactured and sold by Midwest Components, Inc. of Muskegon, Mich.

It is therefore to be understood that while a preferred form of underwater treadmill apparatus 10 has been herein set forth and described, the above and other modifications and changes may be made therein without departing from the spirit and scope of the present invention as defined by the appended claims and reasonable equivalents thereof.

I claim:

1. Underwater treadmill apparatus comprising:

a body of water in an enclosed area;

a treadmill belt submerged in the body of water including a support frame, a drive roller and driven roller about which said treadmill belt is trained;

submerged drive means drivingly connected to said drive roller including a drive shaft in spaced parallel relation to said drive roller, a fluid operated drive motor coupled to said drive shaft and flywheel means coupled to said drive shaft between said fluid operated drive motor and said drive roller, and flexible fluid pressure and return lines extending to and from said drive motor;

electric motor drive means located outside of said body of water including a pressurized fluid source to deliver fluid under pressure via said pressure line to said drive motor; and said support frame being unattached in said body of water and with respect to the enclosed area and wherein said flywheel means cooperates with said support frame in stabilizing said apparatus in the water.

2. In apparatus according to claim 1, wherein said flywheel means is of hollow, generally cylindrical configuration with apertures therein for the entry of water.

3. In apparatus according to claim 1, wherein said drive means includes a sprocket on said drive shaft and a drive belt trained over said sprocket and being drivingly connected to said drive roller.

4. In apparatus according to claim 1, said drive roller composed of a rubber or rubber-like material and having axially spaced, circumferentially extending grooves therein.

5. In apparatus according to claim 1, wherein said treadmill belt has an upper course and lower course, and a rigid deck having raised sidewalls interposed between said upper and lower courses.

6. In apparatus according to claim 5, including a cushion layer disposed on said rigid deck and spaced beneath said upper course of said belt.

7. In apparatus according to claim 5, wherein said upper course is disposed beneath upper edges of said raised sidewalls and said cushion layer is disposed on said deck.

8. In apparatus according to claim 1, said driven roller being of hollow generally cylindrical configuration with apertures for the entry of water into said take-up roller.

9. In apparatus according to claim 1, wherein threadedly adjustable feet extend downwardly from four corners of said frame, and an extension rod is engageable with said feet including means for adjusting the extent of downward projection of said feet from said frame.

10. Aquatic treadmill apparatus comprising:

a body of water;

a treadmill belt submerged in said body of water having an upper course and a lower course including a drive roller and driven roller at opposite ends of said treadmill belt, a support frame resting on a bottom surface beneath said body of water including sidewalls on opposite sides of said treadmill belt and a rigid deck unitary with and extending between said sidewalls beneath said upper course; and submerged drive means drivingly connected to said drive roller including a drive shaft in spaced parallel realtion to said drive roller, a drive motor and flywheel means disposed between said drive motor and said drive roller and wherein said flywheel means cooperates with said support frame in stabilizing said apparatus in the water by imparting a downward force counteracting any tendency of said frame to be lifted from the bottom surface of the enclosed area.

11. Apparatus according to claim 10, wherein said flywheel is of hollow, generally cylindrical configuration.

12. Apparatus according to claim 11, said flywheel provided with apertures for passage of water into said flywheel.

13. Apparatus according to claim 10, wherein said frame includes an individual foot member at each corner of said frame supporting said frame on said bottom surface.

14. Apparatus according to claim 13, including a cushion layer interposed between said said upper and lower courses of said belt.

15. Apparatus according to claim 13, wherein said upper course is disposed slightly beneath the upper edges of said raised sidewalls.

16. Apparatus according to claim 10, wherein electrical motor drive means is located outside of said body of water and includes a pump to deliver fluid under pressure to said drive motor.

17. Aquatic treadmill apparatus comprising:

a body of water in an enclosed area;

a treadmill belt submerged in said body of water including a support frame having a rigid deck and a drive roller and take-up roller at opposite ends of said frame;

submerged drive means drivingly connected to said drive roller including a drive shaft, and a drive motor coupled to said drive shaft and a flywheel coupled to said drive shaft between said drive motor and said driver roller, said flywheel having its maximum weight in an outer peripheral portion thereof, and a pressurized fluid source outside of said body of water to deliver fluid under pressure via said pressure line to said drive motor; and wherein said treadmill belt has an upper course and lower course, said rigid deck interposed between said upper and lower courses, said support frame being unattached to the enclosed area.

18. Apparatus according to claim 17, wherein a guard member extends along one of said opposite ends of said frame slightly beneath said upper course and adjacent to said take-up roller to prevent injury to fingers or toes of a person exercising on said treadmill belt.

19. An underwater treadmill apparatus, said apparatus comprising:

a body of water in an enclosed area;

an endless treadmill belt mounted on a portable, generally rectangular frame and submerged in the body of water, and a drive roller and driven roller about which said treadmill belt is trained;

drive means on said frame drivingly connected to said drive roller including a fluid operated drive motor and fluid pressure and return lines extending to and from said drive motor, a flywheel is mounted between said drive motor and said drive roller, and said flywheel having its greater mass concentrated in an outer peripheral portion thereof; and electric motor drive means located outside of said body of water including a fluid pump to deliver fluid under pressure via said pressure line to said drive motor.

20. In apparatus according to claim 19, wherein said drive means includes a drive shaft, said fluid drive motor coupled to said drive shaft and a flywheel coupled to said drive shaft.

21. In apparatus according to claim 20, wherein said drive means includes a sprocket on said drive shaft and a drive belt trained over said sprocket and being drivingly connected to said drive roller, said drive roller having axially spaced, circumferentially extending grooves therein, and said treadmill belt has an upper course and lower course, a rigid deck interposed between said upper and lower courses, said upper course being disposed beneath upper edges of said raised sidewalls, and a cushion layer interposed between said deck and said upper course of said belt.

22. In apparatus according to claim 19, wherein a compressible padding is disposed in outer surrounding relation to sides of said frame.

23. In apparatus according to claim 19, wherein flags are disposed at corners of said frame.

24. Aquatic treadmill apparatus comprising:

a body of water;

a frame member submerged in said body of water;

a treadmill belt including a drive roller and take-up roller mounted on said frame member at opposite ends of said treadmill belt;

said frame member resting on a bottom surface beneath said body of water including sidewalls on opposite sides of said treadmill belt and a rigid deck extending between the sidewalls beneath an upper course of said treadmill belt, and an individual foot member at each of four corners of said frame resting on said bottom surface; and drive means on said frame member drivingly connected to said drive roller including a drive shaft, a fluid-powered drive motor and flywheel means mounted for rotation with said drive shaft between said drive motor and said drive roller wherein said flywheel means cooperates with said frame member in stabilizing said apparatus in the water.

25. Apparatus according to claim 24, wherein said flywheel is of hollow, generally cylindrical configuration having its greater mass concentrated in an outer peripheral portion thereof, and said flywheel provided with apertures for passage of water into said flywheel.

26. Apparatus according to claim 24, wherein said treadmill belt has an upper course and lower course, a rigid deck interposed between said upper and lower courses, and a cushion layer interposed between said deck and said upper course of said belt.

27. Apparatus according to claim 23, wherein said interrupt means includes surge suppressor means for closing said interrupt means to conduct electrical current for limited time periods at voltages greater than 40 volts.

28. Apparatus according to claim 27, wherein said diodes include avalanche diodes and a surge suppressor in parallel with said diodes.

29. Apparatus according to claim 27, wherein said motor drive means includes a motor having an electrically non-conductive coating and sacrificial anodes in outer spaced relation to said motor to prevent corrosion of said motor.

30. Apparatus according to claim 29, said sacrificial anodes being composed of a metal selected from the group consisting of magnesium, aluminum and zinc.

31. In underwater treadmill apparatus having a body of water in an enclosed area, a treadmill belt submerged in said body of water including a frame member, a drive roller and a take-up roller at opposite ends of said frame, the improvement comprising:

said take-up roller including bearing means at opposite ends thereof for resiliently mounting said take-up roller on said frame member wherein said take-up roller is movable toward and away from said drive roller in response to foot pressure applied by an exerciser to said treadmill belt.

32. In apparatus according to claim 31, wherein a guard member extends along one of said opposite ends of said treadmill belt adjacent to said take-up roller, said guard member being connected to said bearing means.

33. In apparatus according to claim 31, wherein said drive roller includes an outer tread portion of resilient material.

34. In apparatus according to claim 33 wherein said outer tread portion has axially spaced circumferential grooves therein.

35. In apparatus according to claim 31, wherein said take-up roller is of hollow, generally cylindrical configuration and provided with apertures for the entry of water into said take-up roller.

36. In apparatus according to claim 31, wherein said portable frame member is of generally rectangular configuration having raised straddle portions on opposite sides thereof, a deck extending between said straddle portions, and a cushion layer mounted on said deck.

37. In apparatus according to claim 36, said treadmill belt being in the form of an endless belt having an upper course spaced over said deck with water passing therebetween.

38. In apparatus according to claim 36, said deck being spaced beneath said straddle portions.

39. In apparatus according to claim 31, wherein said cushion layer is composed of compressible plastic bubbles, and a flexible plate mounted on said cushion layer beneath an upper course of said treadmill belt.

40. In apparatus according to claim 31, said treadmill belt provided with marker means visible to an exerciser from above the surface of the water to signal to the exerciser whether the belt is stationary or moving.

41. Aquatic treadmill apparatus comprising:

a body of water;

a frame member submerged in said body of water;

a treadmill belt including a drive roller and take-up roller mounted on said frame member at opposite ends of said treadmill belt; and drive means on said frame member drivingly connected to said drive roller wherein electric motor drive means is located outside of said body of water and includes a fluid pump driven by said motor drive means to deliver fluid under pressure to said drive means and wherein a bonding grid is electrically connected between said electric motor drive means and said frame member, and interrupt means including diodes in said bonding grid for interrupting current flow through said bonding grid at voltages less than two volts.

42. Underwater treadmill apparatus comprising:

a body of water in an enclosed area;

a support frame submerged in the body of water and resting on a bottom surface of the enclosed area;

a treadmill belt mounted on said support frame including a drive roller at a forward end of said support frame and a driven roller at a rearward end of said support frame with said treadmill belt being trained for advancement over said drive roller and said driven roller;

submerged drive means drivingly connected to said drive roller including a fluid-operated drive motor and flexible fluid pressure and return lines extending to and from said drive motor;

electric motor drive means located outside of said body of water including a pressurized fluid source to deliver fluid under pressure via said pressure line to said drive motor; and stabilizing means cooperating with said support frame wherein said stabilizing means stabilizes the apparatus in the body of water by imparting a downward force to said rear end of said support frame to counteract any tendency of said rear end of said support frame to be lifted off of the bottom surface when said drive motor is in operation.

43. Underwater treadmill apparatus according to claim 42 wherein said stabilizing means imparts a substantially constant downward pressure to said rear end of said support frame when said apparatus is in operation.

* * * * *